US008315535B2

(12) United States Patent
Shintani et al.

(10) Patent No.: US 8,315,535 B2
(45) Date of Patent: Nov. 20, 2012

(54) CLEANING UNIT, PROCESS CARTRIDGE INCORPORATING SAME, AND IMAGE FORMING APPARATUS INCORPORATING THE CLEANING UNIT

(75) Inventors: Takeshi Shintani, Kawasaki (JP); Nobuo Kuwabara, Yokohama (JP); Satoshi Hatori, Yokohama (JP); Daisuke Tomita, Yokohama (JP); Akio Kosuge, Yokohama (JP); Yoshinori Ozawa, Atsugi (JP); Shinichi Kawahara, Tokyo (JP); Takaya Muraishi, Kawasaki (JP); Yasushi Akiba, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 417 days.

(21) Appl. No.: 12/591,916

(22) Filed: Dec. 4, 2009

(65) Prior Publication Data

US 2010/0189461 A1 Jul. 29, 2010

(30) Foreign Application Priority Data

Jan. 23, 2009 (JP) ..... 2009-012476

(51) Int. Cl.
*G03G 21/20* (2006.01)

(52) U.S. Cl. ..... 399/94; 399/123; 399/346; 399/350

(58) Field of Classification Search ..... 399/94, 399/123, 346, 350
See application file for complete search history.

(56) References Cited

U.S. PATENT DOCUMENTS

| | | | |
|---|---|---|---|
| 7,035,582 | B2 | 4/2006 | Suda et al. |
| 7,065,316 | B2 | 6/2006 | Yanagida et al. |
| 7,085,528 | B2 | 8/2006 | Shintani et al. |
| 7,110,696 | B2 | 9/2006 | Murakami et al. |
| 7,228,099 | B2 | 6/2007 | Shintani et al. |
| 7,272,354 | B2 | 9/2007 | Murakami et al. |
| 7,292,816 | B2 | 11/2007 | Ojimi et al. |
| 7,391,991 | B2 | 6/2008 | Suda et al. |
| 7,427,029 | B2 | 9/2008 | Bailleu et al. |
| 7,493,075 | B2 | 2/2009 | Shintani et al. |
| 7,532,849 | B2 | 5/2009 | Akiba et al. |
| 2004/0136763 | A1 | 7/2004 | Murakami et al. |
| 2004/0141779 | A1 | 7/2004 | Yanagida et al. |
| 2004/0170455 | A1 | 9/2004 | Shintani et al. |
| 2005/0002705 | A1 | 1/2005 | Shintani et al. |

(Continued)

FOREIGN PATENT DOCUMENTS

JP 59127080 A * 7/1984

(Continued)

*Primary Examiner* — Walter L Lindsay, Jr.
*Assistant Examiner* — Benjamin Schmitt
(74) *Attorney, Agent, or Firm* — Harness, Dickey & Pierce, P.L.C.

(57) ABSTRACT

A cleaning unit, which can be incorporated in a process cartridge removably installable in an image forming apparatus, includes a lubricant applicator to apply lubricant to an image carrier, a first blade disposed upstream from the lubricant applicator in a direction of rotation of the image carrier with its distal end held in contact with the image carrier to remove residual toner remaining on the image carrier, a second blade disposed downstream from the lubricant applicator in the direction of rotation of the image carrier with its distal end held in contact with the image carrier to regulate the amount of lubricant applied to the image carrier, a temperature measuring member to measure a temperature of or near the second blade, a heater, and a temperature controller to control the heater to heat the second blade so that the measured temperature falls within a given set temperature range.

20 Claims, 3 Drawing Sheets

U.S. PATENT DOCUMENTS

| | | | |
|---|---|---|---|
| 2005/0019070 | A1 | 1/2005 | Suda et al. |
| 2005/0164108 | A1 | 7/2005 | Murakami et al. |
| 2005/0196194 | A1 | 9/2005 | Suda et al. |
| 2005/0232666 | A1 | 10/2005 | Ojimi et al. |
| 2006/0216085 | A1 | 9/2006 | Murakami et al. |
| 2007/0009293 | A1 | 1/2007 | Akiba et al. |
| 2007/0154246 | A1 | 7/2007 | Shintani et al. |
| 2007/0199999 | A1 | 8/2007 | Bailleu et al. |
| 2008/0069615 | A1 * | 3/2008 | Shintani et al. ..... 399/346 |
| 2009/0142115 | A1 | 6/2009 | Muraishi et al. |

FOREIGN PATENT DOCUMENTS

| | | | |
|---|---|---|---|
| JP | 02244185 | A * | 9/1990 |
| JP | 2000-330443 | | 11/2000 |

* cited by examiner

CLEANING UNIT, PROCESS CARTRIDGE INCORPORATING SAME, AND IMAGE FORMING APPARATUS INCORPORATING THE CLEANING UNIT

CROSS-REFERENCE TO RELATED APPLICATIONS

The present patent application claims priority pursuant to 35 U.S.C. §119 from Japanese Patent Application No. 2009-012476, filed on Jan. 23, 2009 in the Japan Patent Office, which is hereby incorporated by reference herein in its entirety.

BACKGROUND OF THE INVENTION

1. Field of the Invention

Example embodiments of the present patent application generally relate to a cleaning unit, a process unit incorporating the cleaning unit, and an image forming apparatus incorporating the cleaning unit.

2. Discussion of the Related Art

Image forming apparatuses typically include a cleaning unit disposed together with a rotatable image carrier that bears an image. The cleaning unit includes, for example, a pair of rubber blades disposed in slidable contact with the rotatable image carrier. A lubricant applicator that applies lubricant to the image carrier is disposed between the pair of rubber blades, such that one of the pair of rubber blades is disposed upstream from the lubricant and the other is disposed downstream from the lubricant in a direction of rotation of the image carrier. The upstream rubber blade removes residual toner remaining on a surface of the image carrier while the downstream rubber blade regulates the amount of lubricant applied to the surface of the image carrier to make the lubricant uniform over the surface of the image carrier.

However, over time the pair of rubber blades of the known cleaning unit is susceptible to compression set, in which the blades become permanently bent. As a result, a small gap can be formed between the leading edge of each rubber blade and the surface of the image carrier with which the blades are supposed, to be in contact. This gap is likely to cause insufficient removal of residual toner and uneven regulation of the amount of lubricant.

Moreover, if compression set occurs, because the above-described rubber blades are disposed on either side of the lubricant applicator, that is, disposed upstream and downstream from the lubricant applicator in the direction of rotation of the image carrier, any residual toner remaining on the surface of the image carrier after passing under the upstream rubber blade may need to be dammed by the downstream rubber blade even as the downstream rubber blade regulates the amount of lubricant, which may damage the downstream rubber blade, allowing toner to mix with the lubricant.

SUMMARY OF THE INVENTION

Example aspects of the present patent application have been made in view of the above-described circumstances.

Example aspects of the present patent application provide a cleaning unit that can effectively prevent causing compression set of a cleaning blade made of rubber material.

Other example aspects of the present patent application provide a process unit that can incorporate the above-described cleaning unit.

Other example aspects of the present patent application provide an image forming apparatus that can incorporate the above-described cleaning unit.

In one example embodiment, a cleaning unit, which cleans an image carrier that bears an image on a surface thereof, includes a lubricant applicator to apply lubricant to an image carrier that carries an image on a surface thereof, a first blade disposed upstream from the lubricant applicator in a direction of rotation of the image carrier with a distal end of the first blade held in contact with the image carrier, the first blade removing residual toner remaining on the surface of the image carrier, a second blade disposed downstream from the lubricant applicator in a direction of rotation of the image carrier with a distal end of the second blade held in contact with the image carrier, the second blade regulating the amount of lubricant applied to the surface of the image carrier, a temperature measuring member to measure one of a temperature of the second blade and an ambient temperature of the second blade, a heater disposed in the vicinity of the second blade to heat the second blade, and a temperature controller electrically connected to the heater to control the heater to heat the second blade so that the temperature obtained by the temperature measuring member falls within a given set temperature range that includes an upper limit and a lower limit.

The temperature controller controls the heater to start heating when the measured temperature is below the lower limit of the give set temperature range and to stop heating when the measured temperature is at or above the upper limit of the given set temperature range.

The lower limit of the given set temperature range is approximately 18 degrees Celsius and the upper limit of the given set temperature range is approximately 25 degrees Celsius.

With the above-described temperature condition, the distal end of the second blade contacts the image carrier at an edge angle thereof in a range of greater than approximately 90 degrees and less than approximately 140 degrees.

The temperature controller issues a signal to interrupt an image forming operation when the measured temperature is out of the given set temperature range.

The temperature controller issues a signal to interrupt an image forming operation when the measured temperature is below the lower limit.

The second blade includes a base that is fixedly mounted on a casing, and the distal end of the second blade disposed upstream from the base of the second blade in the direction of rotation of the image carrier.

The distal end of the second blade contacts the image carrier at an edge angle thereof in a range of greater than approximately 90 degrees and less than approximately 140 degrees.

Further, in one example embodiment, a process cartridge removably installable in an image forming apparatus includes the above-described cleaning unit, with the image carrier serving as a photoconductor drum, a charging unit to uniformly charge the surface of the image carrier, and a developing unit to develop the image on the surface of the image carrier from a latent image into a visible toner image.

Further, in one example embodiment, an image forming apparatus includes the above-described cleaning unit, with the image carrier serving as a photoconductor drum, a charging unit disposed facing the image carrier to uniformly charge the surface of the image carrier, an optical writing unit disposed above the image carrier and the cleaning unit to emit a laser light beam to form a latent image on the surface of the image carrier, a developing unit disposed facing the image carrier to develop the image on the surface of the image carrier from a latent image into a visible toner image, and a transfer member to transfer the toner image formed on the surface of the image carrier onto a surface thereof.

The cleaning unit, the charging unit, and the developing unit may be unitized as a process cartridge removably installable in the above-described image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
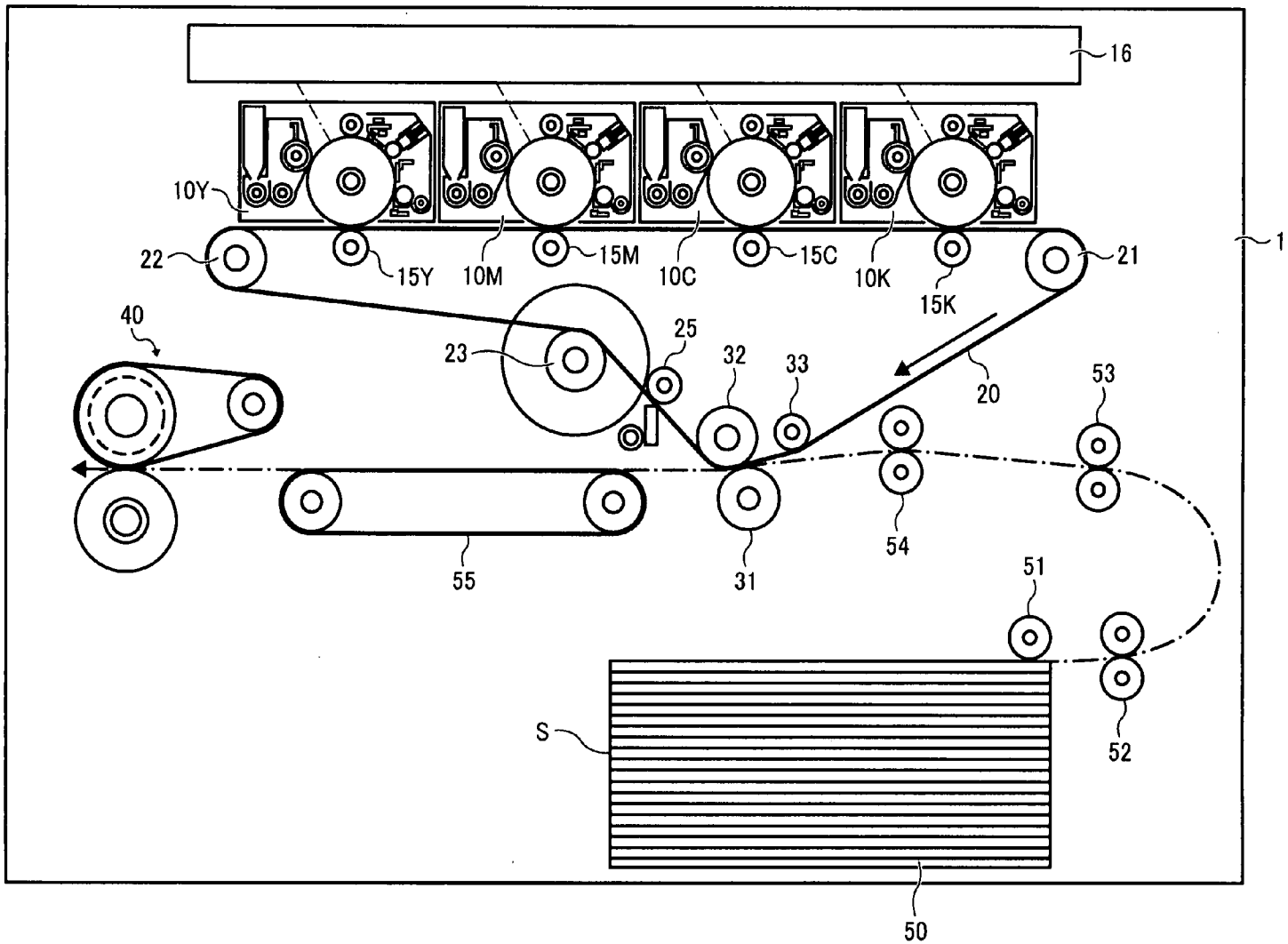
FIG. 1 is a schematic configuration of an image forming apparatus according to an example embodiment of the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present patent application.

The present patent application includes a technique applicable to any image forming apparatus. For example, the technique of the present patent application is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

FIG. 1 illustrates a schematic configuration of the image forming apparatus 1 according to an example embodiment of the present patent application.

The image forming apparatus 1 can be any of a copier, a printer, a facsimile machine, a plotter, and a multifunction printer including at least one of copying, printing, scanning, plotter, and facsimile functions. In this non-limiting example embodiment, the image forming apparatus 1 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 1 according to this example embodiment is a tandem-type color image forming apparatus that can form full color images, as shown in FIG. 1. The image forming apparatus 1 includes four process cartridges 10Y (for yellow toner image), 10M (for magenta toner image), 10C (for cyan toner image), and 10K (black toner image), multiple rollers 21, 22, 23, 25, 32, and 33, and an intermediate transfer belt 20 that serves as a transfer member.

The four process cartridges 10Y, 10M, 10C, and 10K are disposed held in contact with the intermediate transfer belt 20 that is spanned around the multiple rollers 21, 22, 23, 25, 32, and 33 and are aligned along a moving direction of an upper part of the intermediate transfer belt 20. The four process cartridges 10Y, 10M, 10C, and 10K can be removably installable to a main body of the image forming apparatus 1 for replacement.

Since the four process cartridges 10Y, 10M, 10C, and 10K for yellow (Y), magenta (M), cyan (C), and black (K) have similar configurations to each other, except for the colors of toners, it is also referred to as a process cartridge 10 without suffixes. At the same time, components and units provided in the process cartridges 10Y, 10M, 10C, and 10K are denoted by common reference numerals without suffixes "Y", "M", "C", and "K" that are generally used to distinguish the colors.

Figure 2:
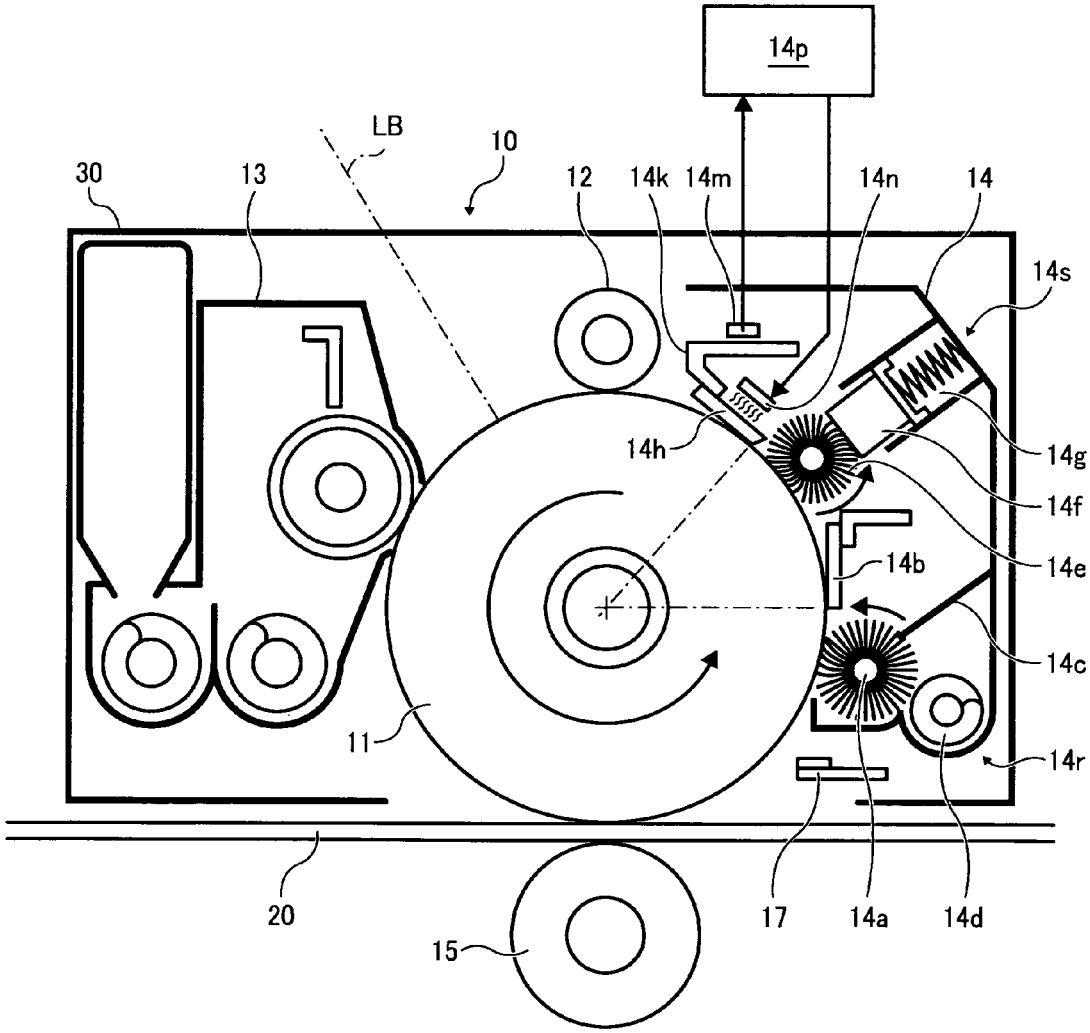
FIG. 2 is a schematic configuration of a process cartridge incorporated in the image forming apparatus of FIG. 1.

As shown in FIG. 2, the process cartridge 10 includes a photoconductor drum 11 that serves as an image carrier and is surrounded by a charging unit 12, a developing unit 13, a pre-cleaning discharging lamp 17, and a cleaning unit 14 disposed therearound.

The charging unit 12 is disposed facing the photoconductor drum 11 to uniformly charge the surface of the photoconductor drum 11.

The developing unit 13 is disposed facing the photoconductor drum 11 to develop an image formed on the surface of the photoconductor drum 11 from a latent image into a visible toner image.

The pre-cleaning discharging lamp 17 also faces the photoconductor drum 11 to electrically discharge the surface of the photoconductor drum 11.

The cleaning unit 14 is disposed facing the photoconductor drum 11 to clean the surface of the photoconductor 11 by removing residual toner therefrom.

These components may be disposed integrally in a machine casing 30 of the process cartridge 10 that is removably installable in the main body of the image forming apparatus 1.

The process cartridge 10 having the above-described configuration is disposed in contact with an outer surface of the loop of the intermediate transfer belt 20 so that the photoconductor drum 11 can face a primary transfer roller 15 that is disposed in contact with an inner surface of the loop of the intermediate transfer belt 20. Details of the cleaning unit 14 will be described later.

As shown in FIG. 1, an optical writing unit 16 is disposed above each process cartridge 10. The optical writing unit 16 emits a laser light beam LB to the surface of the photoconductor drum 11 in a range between the charging unit 12 and the developing unit 13 to form a latent image formed according to image data.

A pair of registration rollers 54 is disposed at the right-hand side of a transfer roller 31 in FIG. 1 and an endless conveyance belt 55 is disposed at the left-hand side of the transfer roller 31. Further, a belt fixing unit 40 is disposed at the left-hand side of the endless conveyance belt 55 in FIG. 1.

A sheet feed tray 50 is located at a lower part of the image forming apparatus 1. The sheet feed tray 50 accommodates a stack of transfer sheets including a transfer sheet S and includes a pickup roller 51 and a separation feed roller 52 that serve as sheet feed members.

In FIG. 1, a conveyance roller 53 is disposed at a given position along a transfer sheet conveyance path indicated by a long dashed short dashed line. In addition, a not-illustrated transfer sheet guide may be disposed along the transfer sheet conveyance path. Further, if necessary, a manual sheet feeder and/or a transfer sheet reversing unit. Furthermore, an image reading device (scanner) and/or an automatic document feeder (ADF) can be installed to the image forming apparatus 1.

Next, a description is given of image forming operations performed by the image forming apparatus 1 according to the present patent application.

In FIG. 1, the photoconductor drum 11 is rotated by a drive unit, not shown, in a counterclockwise direction. The charging unit 12 uniformly charges the surface of the photoconductor 11 to a give polarity. The optical writing unit 16 emits the laser light beam LB to the charged surface of the photoconductor 11 so as to form an electrostatic latent image on the surface thereof. At this time, the optical writing unit 16 emits the laser light beam LB according to image data used to irradiate the surface of the photoconductor drum 11 is for each single color image after color separation from a given full-color image to each of yellow, magenta, cyan and black. The developing unit 13 supplies a corresponding color of toner to each electrostatic latent image to develop into a visible toner image.

The intermediate transfer belt 20 serves as a transfer member and is rotated in a clockwise direction. The intermediate transfer belt 20 transfers a toner image formed on the surface of the photoconductor drum 11 onto the surface thereof. More specifically, by action of the primary transfer roller 15, each single color toner image of the process cartridges 10Y, 10M, 10C, and 10K is transferred from the surface of the photoconductor drum 11 to the surface of the intermediate transfer belt 20 to form an overlaid toner color image. Thus, the intermediate transfer belt 20 carries and conveys a full-color toner image.

Alternative to formation of a full-color toner image, a single color image can be formed with any one of single process cartridges 10 or a two-color or three-color image can be formed with multiple process cartridges 10. When forming and printing a monochrome image, the process cartridge 10K only is used while the other three process cartridges 10Y, 10M, and 10C are currently not used.

In FIG. 2, residual toner remaining on the surface of the photoconductor drum 11 after image transfer is removed by the cleaning unit 14, and lubricant is applied to the surface of the photoconductor drum 11 to regulate a layer of applied lubricant on the surface of the photoconductor drum 11. Then, the surface of the photoconductor drum 11 receives the laser light beam emitted by the pre-cleaning discharging lamp 17 so that potential of the surface of the photoconductor drum 11 to be initialized to be ready for a subsequent image forming operation.

On the other hand, in FIG. 1, the transfer sheet S is fed from the sheet feed tray 50 and is conveyed toward the pair of registration rollers 54. The pair of registration rollers 54 stops and feeds the transfer sheet S to a secondary transfer position in synchronization with movement of the toner image carried by the surface of the intermediate transfer belt 20. The transfer roller 31 that serves as a secondary transfer unit transfers the toner image formed on the surface of the intermediate transfer belt 20 onto the transfer sheet S. The transfer sheet S having the toner image on the surface thereof is conveyed by the endless conveyance belt 55 to the belt fixing unit 40. The belt fixing unit 40 fixes the toner image to the transfer sheet S by application of heat and pressure. The transfer sheet S with the fixed toner image is discharged to a sheet discharging tray, not shown.

Next, a detailed description is given of operations and structure of the cleaning unit 14 according to the present patent application, by referring to FIG. 2.

The cleaning unit 14 includes a residual toner clean and collection mechanism 14*r*, a lubricant application mechanism 14*s*, a lubricant regulating rubber blade 14*h*, a temperature measuring member 14*m*, a heater 14*n*, and a temperature controller 14*p*.

The residual toner clean and collection mechanism 14*r* is disposed upstream from the lubricant application mechanism 14*s* in a direction of rotation of the photoconductor drum 11 and includes a cleaning fur brush 14*a*, a cleaner rubber blade 14*b*, a flicker 14*c*, and a conveyance screw 14*d*.

The cleaning fur brush 14*a* is rotated by a drive unit, not shown, in a counterclockwise direction of FIG. 2 and brushes the surface of the photoconductor drum 11 to remove residual toner remaining thereon.

The cleaner rubber blade 14*b* serves as a first blade and includes a fixed end and a distal end. The cleaning rubber blade 14*b* is disposed so that the distal end can be positioned substantially on a normal line (NL) of the photoconductor drum 11 and substantially along a tangent line (TL) of the photoconductor drum 11. The distal end of the cleaner rubber blade 14*b* includes urethane rubber having a strip shape and is held in contact with the photoconductor drum 11 across the width of the photoconductor drum 11 or in an axial direction thereof to remove the residual toner therefrom.

The flicker 14*c* flicks the residual toner remaining on the cleaning fur brush 14*a*.

The conveyance screw 14*d* collects and conveys the residual toner out of the cleaning unit 14.

The lubricant application mechanism 14*s* includes a lubricant application fur brush 14*e*, lubricant 14*f*, and a lubricant supporting member 14*g*.

The lubricant application fur brush 14*e* serves as a lubricant applicator and applies the lubricant 14*f* to the surface of the photoconductor drum 11. The lubricant application fur brush 14*e* is rotated by a drive unit, not shown, in a counterclockwise direction of FIG. 2 and is disposed in contact with the surface of the photoconductor drum 11.

The lubricant 14*f* includes metal soap made of zinc stearate or the like.

The lubricant supporting member 14*g* supports the lubricant 14*f* by elastically biasing the lubricant application fur brush 14*e* to contact the lubricant 14*f* to the lubricant application fur brush 14*e*.

The lubricant application mechanism 14*s* is disposed downstream from the residual toner clean and collection mechanism 14*r* in a direction of rotation of the photoconductor drum 11. The lubricant application fur brush 14*e* to which the lubricant 14*f* is attached contacts, while rotating, with the surface of the photoconductor drum 11 after cleaned by the residual toner clean and collection mechanism 14*r*. By so doing, the lubricant 14*f* may be applied to the surface of the surface of the photoconductor drum 11.

The lubricant regulating rubber blade 14*h* serves as a second blade and is disposed downstream from the lubricant application fur brush 14*e* in a direction of rotation of the photoconductor drum 11. The lubricant regulating rubber blade 14*h* includes urethane rubber having a strip shape and has a fixed end and a distal end. The fixed end of the lubricant regulating rubber blade 14*h* is fixed to a supporting member 14*k* that is fixedly attached to the machine casing 30. The lubricant regulating rubber blade 14*h* is disposed downstream from the lubricant application mechanism 14*s* in the direction of rotation of the photoconductor so that the distal end of the lubricant regulating rubber blade 14*h* may be positioned substantially on the normal line (NL) of the photoconductor drum 11, substantially along the tangent line (TL) of the photoconductor drum 11, and be held in contact with the photoconductor drum 11 across the width of the photoconductor drum 11 or in an axial direction thereof. With the above-described configuration, the lubricant regulating rubber blade 14*h* can regulate the amount of lubricant applied to the surface of the photoconductor drum 11 by the lubricant application mechanism 14*s*.

Figure 3:
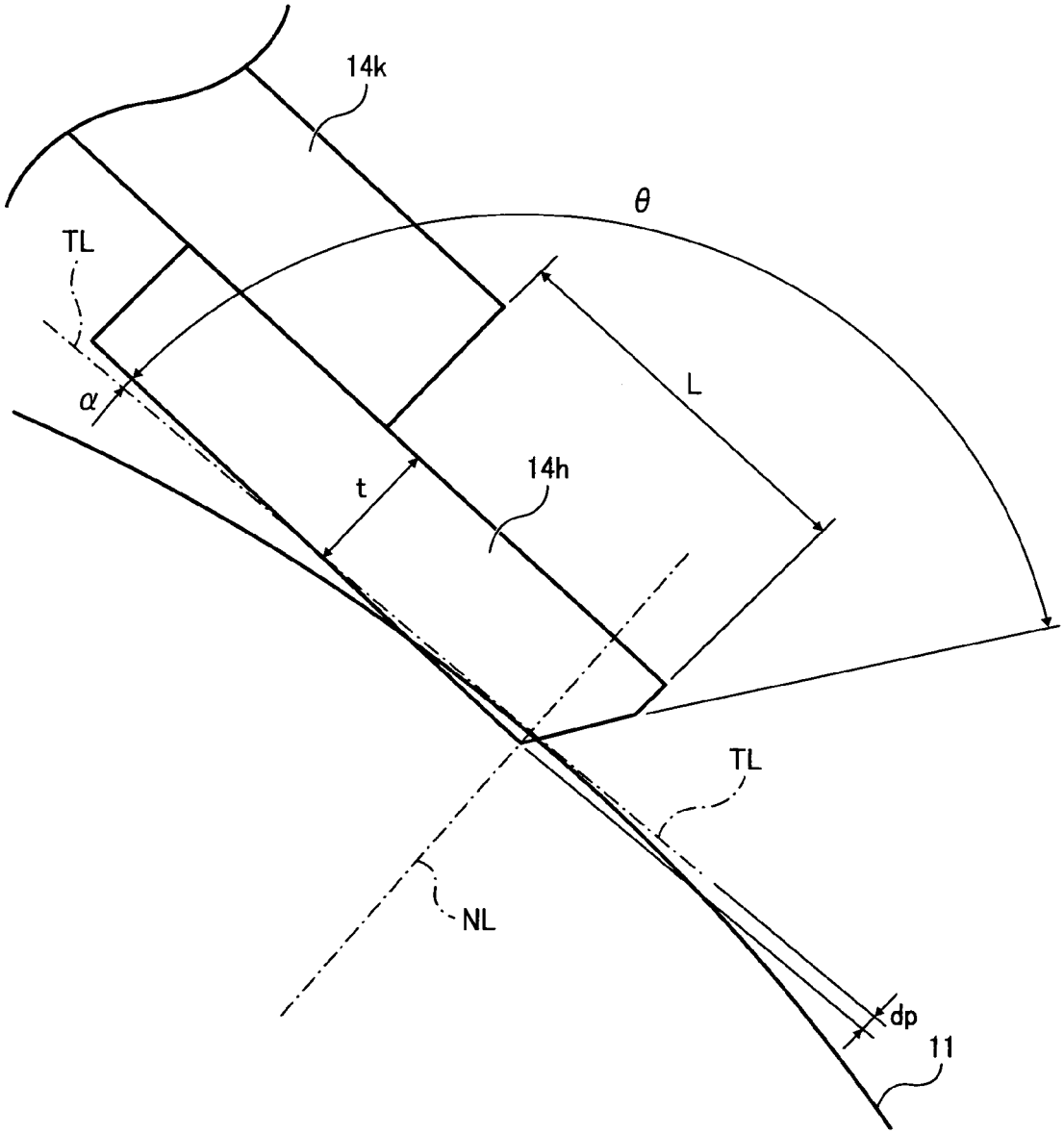
FIG. 3 is an enlarged view of a cleaning unit incorporated in the image forming apparatus of FIG. 1.

As shown in FIG. 3, the distal end of the lubricant regulating rubber blade 14*h* contacts the surface of the photoconductor drum 11 at an edge angle θ of 90 degrees or greater with respect to the surface of the photoconductor drum 11. The edge angle θ of the lubricant regulating rubber blade 14*h* is set to 120 degrees with respect to the photoconductor drum 11 in FIG. 3, as an example.

The above-described value of the edge angle θ of the lubricant regulating rubber blade 14*h* is specified to hinder wear of the lubricant regulating rubber blade 14*h* as slow as possible by reducing mechanical stress against the contact end.

When the edge angle θ thereof is 140 degrees or greater, the lubricant regulating rubber blade 14*h* may become unstable to cause chattering, which can lead to low frequency vibration and decrease accuracy in regulation evenness of the layer of lubricant applied to the surface of the photoconductor drum 11, that is, the ability of the lubricant regulating rubber blade 14*h* to regulate the thickness of the lubricant can deteriorate. Accordingly, the edge angle θ of the lubricant regulating rubber blade 14*h* is preferably equal to 90 degrees or greater and less than 140 degrees.

The temperature measuring member 14*m* includes a non-contact or contactless temperature sensor of thermal type or quantum type. The temperature measuring member 14*m* is disposed outside the supporting member 14*k* so as to measure a temperature near the lubricant regulating rubber blade 14*h*. Since the temperature near the lubricant regulating rubber blade 14*h* and the temperature of the lubricant regulating rubber blade 14*h* is substantially equal to each other, from a viewpoint of the contactless-type temperature sensor, the temperature measuring member 14*m* measures an ambient temperature of the lubricant regulating rubber blade 14*h*, which is a temperature near the lubricant regulating rubber blade 14*h*. Alternatively, a quantum-type contactless thermal sensor such as a thermopile infrared ray sensor can be used by disposing facing the lubricant regulating rubber blade 14*h*. With this configuration, the temperature of the surface of the lubricant regulating rubber blade 14*h* may also be measured accurately.

The heater 14*n* includes a halogen heater, a ceramic heater, and the like. The heat member 14*n* is disposed in the vicinity of the rear side of the lubricant regulating rubber blade 14*h* so as to heat the entire body of the lubricant regulating rubber blade 14*h*.

The temperature controller 14*p* is electrically connected to the heater 14*n* and the temperature measuring member 14*m* to control a temperature for the heater 14*n* to heat the lubricant regulating rubber blade 14*h* based on a temperature measured by the temperature measuring member 14*m* and a given temperature that is previously specified. The given temperature can be a single target temperature. However, for the purpose of easily controlling the temperature by the temperature controller 14*p*, this example embodiment of the present patent application employs a given set temperature range that has a lower limit and an upper limit so that the measured temperature obtained by the temperature measuring member 14*m* falls between the lower and upper limits of the given set temperature range.

Next, a description is given of a series of temperature control procedures performed by the temperature controller 14*p*.

On turning on the power of the main body of the image forming apparatus 1, the temperature controller 14*p* is started, which starts the temperature measuring member 14*m* immediately to measure the temperature in the vicinity of the lubricant regulating rubber blade 14*h*.

When the measured temperature obtained by the temperature measuring member 14*m* is 18 degrees Celsius or below, which is the lower limit of the given set temperature range, compression set of rubber can easily occur because of the condition under a cool environment. Therefore, the temperature controller 14*p* may transmit a signal indicating not to perform image forming operations, to a control unit that is provided in the main body of the image forming apparatus 1 and integrally controls the image forming operations. At the same time, the temperature controller 14*p* may also cause the heat member 14*n* to start heating the lubricant regulating rubber blade 14*h*.

The temperature measuring member 14*m* constantly measures the temperature in the vicinity of the lubricant regulating rubber blade 14*h*. When the measured temperature obtained by the temperature measuring member 14*m* reaches and further goes above 18 degrees Celsius, the temperature controller 14*p* may transmit a signal indicating to permit the image forming operations, to the control unit provided in the main body of the image forming apparatus 1.

During the above-described transmission, the heater 14*n* continues heating of the lubricant regulating rubber blade 14*h*. When the measured temperature obtained by the temperature measuring member 14*m* reaches 25 degrees Celsius, which is the upper limit of the given set temperature range, the temperature controller 14*p* may cause the heater 14*n* to stop heating the lubricant regulating rubber blade 14*h* to prevent a decrease in hardness of the rubber, occurrence of compression set under the condition in a high temperature, adhesion of toner particles, defectiveness in image forming caused by toner blocking, and the like.

Thereafter, when the measured temperature obtained by the temperature measuring member 14*m* drops to 18 degrees Celsius or below, which is the lower limit of the given set temperature range, the temperature controller 14*p* may cause the heat member 14*n* to start heating the lubricant regulating rubber blade 14*h* until the measured temperature obtained by the temperature measuring member 14*m* goes up to the upper limit of the given set temperature range, that is, 25 degrees Celsius.

As described above, the temperature controller 14*p* may control the temperature of the lubricant regulating rubber blade 14*h* to fall within a range between 18 degrees Celsius and 25 degrees Celsius constantly. By so doing, the temperature of the lubricant regulating rubber blade 14*h* can maintain a temperature which can substantially avoid compression set of the lubricant regulating rubber blade 14*h* and prevent variation of characteristics of the lubricant regulating rubber blade 14*h*.

To avoid compression set of rubber material under the condition in a cool temperature as described in the example embodiment of the present patent application, it is effective for the rubber blade used in the cleaning unit of this type of image forming apparatuses that the heater 14*n* starts heating the lubricant regulating rubber blade 14*h* at the temperature of 18 degrees Celsius.

Next, a description is given of an example of the lubricant regulating rubber blade 14*h* and units and components therearound, by referring to FIG. 3.

EXAMPLE

Parameters of the lubricant regulating rubber blade 14*h* and units and components disposed therearound are set as follows:

Consumption amount of lubricant 14*f* (see FIG. 2) that includes zinc stearate scraped by the lubricant application fur brush 14*e* (see FIG. 2): 120 mg/Km to 150 mg/Km per distance of movement of the photoconductor drum 11;

The lubricant regulating rubber blade 14*h:* Urethane rubber having rubber hardness of 70 degrees (JIS A hardness);

Thickness of the lubricant regulating rubber blade 14*h* (indicated as "t" in FIG. 3): 1.5 mm;

Amount of projection (indicated as "L" in FIG. 3) or distance between a distal end surface of the supporting member 14*k* and a distal end surface of the lubricant regulating rubber blade 14*h:* 6 mm;

Initial contact angle (indicated as "α" in FIG. 3) or angle of the lubricant regulating rubber blade 14*h* inclined in a clockwise direction from the tangent line (indicated as "TL" in FIG. 3) at a contact point of the surface of the photoconductor drum 11 and the distal end of the lubricant regulating rubber blade 14*h:* 9.5 degrees; The edge angle (indicated as "θ" in FIG. 3): 120 degrees;

Amount of overcut or depth of pressure (indicated as "dp" in FIG. 3), which is an amount of initial pressure of the distal end of the lubricant regulating rubber blade 14*h* against the photoconductor drum 11: 0.65 mm; and Position of the distal end of the lubricant regulating rubber blade 14*h:* substantially on the normal line (indicated as "NL" in FIG. 3).

The initial contact angle α directly relates to occurrence of curling of the lubricant regulating rubber blade 14*h*. For example, when the initial contact angle α is set to approximately 20 degrees, the lubricant regulating rubber blade 14*h* can curl up or down easily. The boundary of the initial contact angle α that can avoid occurrence of the curing of the lubricant regulating rubber blade 14*h* is in a range of from approximately 11 degrees to approximately 13 degrees. Thus, the condition of the initial contact angle α may need to be set to a relatively narrow or small degree.

The depth of pressure dp is determined to approximately 6.5 mm for the purpose of minimization of mechanical stress against the photoconductor drum 11. Through tests under this condition, specific problems did not occur at an initial stage of image forming operation. With time, however, an amount of compression set under the condition in a cool temperature increased, which allowed residual toner to pass between the distal end of the lubricant regulating rubber blade 14*h* and the surface, of the photoconductor drum 11, which led to a decrease in uniform application of lubricant, resulting in production of defective images on the photoconductor drum 11.

When the temperature of the lubricant regulating rubber blade 14*h* is set to 18 degrees Celsius under this condition, it has been found that the lubricant regulating rubber blade 14*h* substantially regained its original characteristics of rubber material so that the distal end of the lubricant regulating rubber blade 14*h* closely contacts the surface of the lubricant regulating rubber blade 14*h* with the surface of the photoconductor drum 11 to stop passage of residual toner through the gap between the surface of the photoconductor drum 11 and the distal end of the lubricant regulating rubber blade 14*h*, which can produce images of good quality.

As described above, the image forming apparatus 1 according to the above-described example embodiment of the present patent application, when the measured temperature obtained by the temperature measuring member 14*m* is below 18 degrees Celsius, which is the lower limit of the given set temperature range, the temperature controller 14*p* may control the heater 14*n* to heat the lubricant regulating rubber blade 14*h* so that the measured temperature can fall within the range between 18 degrees Celsius and 25 degrees Celsius, which are the given set temperature range. By so doing, the lubricant regulating rubber blade 14*h* can maintain a temperature that cannot cause compression set easily so as not to degrade the characteristic of the lubricant regulating rubber blade 14*h*, and at the same time, can avoid problems such as production of defective images due to toner blocking. Therefore, the above-described configuration of the lubricant regulating rubber blade 14*h* can effectively dam residual toner passing through the gap formed between the distal end of the lubricant regulating rubber blade 14*h* and the photoconductor drum 11 and apply the lubricant evenly on the surface of the photoconductor drum 11, which can provide images with long-term good quality. In addition, as the temperature controller 14*p* controls the operation to heat only the lubricant regulating rubber blade 14*h* disposed downstream from the cleaner rubber blade 14*b*, cost reduction in this operation can be attained.

As described above, the configuration and functions of the image forming apparatus 1 according to an example embodiment of the present patent application have been described. However, the above-described example embodiment is a preferred example of the configuration and functions of the image forming apparatus 1 described above.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. A cleaning unit for cleaning an image carrier that bears an image on a surface thereof, the cleaning unit comprising:

a lubricant applicator to apply a lubricant to the surface of the image carrier;

a first blade disposed upstream from the lubricant applicator in a direction of rotation of the image carrier with a distal end of the first blade held in contact with the image carrier, the first blade removing residual toner remaining on the surface of the image carrier;

a second blade disposed downstream from the lubricant applicator in a direction of rotation of the image carrier with a distal end of the second blade held in contact with the image carrier, the second blade regulating the amount of the lubricant applied to the surface of the image carrier;

a temperature measuring member to measure one of: a temperature of the second blade and an ambient temperature of the second blade;

a heater disposed in the vicinity of the second blade to heat the second blade; and a temperature controller electrically connected to the heater to control the heater to heat the second blade so that the temperature obtained by the temperature measuring member falls within a given set temperature range that includes an upper limit and a lower limit, wherein the temperature controller issues a signal to interrupt an image forming operation when the a measured temperature is out of the given set temperature range.

2. The cleaning unit according to claim 1, wherein the temperature controller controls the heater to start heating when the measured temperature is below the lower limit of the given set temperature range and to stop heating when the measured temperature is at or above the upper limit of the given set temperature range.

3. The cleaning unit according to claim 2, wherein the lower limit of the given set temperature range is approximately 18 degrees Celsius and the upper limit of the given set temperature range is approximately 25 degrees Celsius.

4. The cleaning unit according to claim 3, wherein the distal end of the second blade contacts the image carrier at an edge angle thereof in a range of greater than approximately 90 degrees and less than approximately 140 degrees.

5. The cleaning unit according to claim 1, wherein the temperature controller issues a signal to interrupt an image forming operation when the measured temperature is below the lower limit.

6. The cleaning unit according to claim 1, wherein the second blade includes a base that is fixedly mounted on a casing, and the distal end of the second blade disposed upstream from the base of the second blade in the direction of rotation of the image carrier.

7. The cleaning unit according to claim 1, wherein the distal end of the second blade contacts the image carrier at an edge angle thereof in a range of greater than approximately 90 degrees and less than approximately 140 degrees.

8. A process cartridge removably installable in an image forming apparatus, the process cartridge comprising:

the cleaning unit according to claim 1, with the image carrier serving as a photoconductor drum;

a charging unit to uniformly charge the surface of the image carrier; and a developing unit to develop the image on the surface of the image carrier from a latent image into a visible toner image.

9. An image forming apparatus, comprising:

the cleaning unit according to claim 1, with the image carrier serving as a photoconductor drum;

a charging unit disposed facing the image carrier to uniformly charge the surface of the image carrier;

an optical writing unit disposed above the image carrier and the cleaning unit to emit a laser light beam to form a latent image on the surface of the image carrier;

a developing unit disposed facing the image carrier to develop the image on the surface of the image carrier from a latent image into a visible toner image; and a transfer member to transfer the toner image formed on the surface of the image carrier onto a surface thereof.

10. The image forming apparatus according to claim 9, wherein the cleaning unit, the charging unit, and the developing unit are unitized as a process cartridge removably installable in the image forming apparatus.

11. The cleaning unit according to claim 1, further comprising:

a cleaning brush to brush the surface of the image carrier;

a flicker to flick the residual toner remaining on the cleaning brush; and a conveyance screw to collect and convey the residual toner out of the cleaning unit.

12. The cleaning unit according to claim 1, wherein the lubricant applicator includes a lubricant application brush, the lubricant, and a lubricant supporting member.

13. The cleaning unit according to claim 12, wherein the lubricant supporting member supports the lubricant by elastically biasing the lubricant application brush so as to contact the lubricant to the lubricant application brush.

14. The cleaning unit according to claim 13, wherein the lubricant is zinc stearate.

15. The cleaning unit according to claim 1, wherein the distal end of the first blade includes urethane rubber having a strip shape.

16. The cleaning unit according to claim 1, wherein the distal end of the second blade includes urethane rubber having a strip shape.

17. The cleaning unit according to claim 1, wherein the temperature measuring member is a non-contact temperature sensor of at least one of a thermal type and a quantum type.

18. The cleaning unit according to claim 1, wherein the temperature measuring member constantly measures the ambient temperature near the second blade.

19. The cleaning unit according to claim 1, wherein the heater is disposed near a rear side of the second blade so as to heat an entire body of the second blade.

20. The cleaning unit according to claim 2, wherein the temperature controller controls the heater to start/stop the heating when the measured temperature is between approximately 18 degrees Celsius and approximately 25 degrees Celsius.

* * * * *